United States Patent [19]

Nagel

[11] 4,142,393

[45] Mar. 6, 1979

[54] PROFILING MACHINE

[75] Inventor: Rudolf Nagel, Schönaich, Fed. Rep. of Germany

[73] Assignee: Maschinen- und Werkzeugbau GmbH, Dortmund-Hombruch, Fed. Rep. of Germany

[21] Appl. No.: 839,261

[22] Filed: Oct. 4, 1977

[30] Foreign Application Priority Data

Oct. 5, 1976 [DE] Fed. Rep. of Germany ..... 2644900

[51] Int. Cl.[2] ..... B21D 5/08

[52] U.S. Cl. ..... 72/181; 72/226; 72/129

[58] Field of Search ..... 72/179, 181, 182, 176, 72/129, 226

[56] References Cited

U.S. PATENT DOCUMENTS

| | | | |
|---|---|---|---|
| 494,904 | 4/1893 | Story | 72/226 |
| 922,536 | 5/1909 | Smith | 72/181 X |
| 1,833,376 | 11/1931 | Simmons | 72/226 |
| 2,179,849 | 11/1939 | Freeze | 72/226 |

*Primary Examiner*—Milton S. Mehr
*Attorney, Agent, or Firm*—Karl F. Ross

[57] ABSTRACT

A machine for shaping elongate strips, especially of metal, into a variety of profiles comprises a cascade of working stations in which the strips are subjected to progressive deformation between rollers, some or all of which may be driven to advance the strips along their transport path through the several stations. Each working station has an annular or star-shaped carrier, rotatable on a support about a horizontal axis, with a plurality of peripherally spaced roller mountings adapted to hold a pair of coacting rollers, the various roller pairs on each carrier being differently shaped to produce a selected profile upon being brought into an operating position -- e.g. horizontal on a level with the axis -- by rotation of the carrier. The operatively positioned roller pair can be coupled with a drive mechanism, individual to the respective station or common to all working stations, for positive rotation thereby.

7 Claims, 6 Drawing Figures

III
118
122
9
121
120
4
103
123
124
5
106
9
W
O
123
124
5
III
107

117
118
30
103
106
119
4
120
122
123
124
5
117'
114
108
107

DRIVING UNIT
DRIVING UNIT
224
225
226
227
206
228
220
9
8'
207'
8
O
V
V
4
206"
203
207

206'
206
206"
203
224
W
9
227
4
207'
207
214
8

PROFILING MACHINE

FIELD OF THE INVENTION

My present invention relates to a machine for the profiling of flat elongate workpieces, such as strips of steel or other metals coming from a rolling mill, in order to provide them with a variety of different cross-sections.

BACKGROUND OF THE INVENTION

Machines used for this purpose generally comprise a plurality of cascaded working stations in which a strip is progressively deformed while still at an elevated temperature. The deformation is carried out between roller pairs of suitable shape and is usually followed by cutting the deformed strip into sections of desired length. The rollers of one or more working stations may be positively driven to advance the workpieces along a predetermined transport path; some of these rollers, especially driven ones, need not have a deforming function but may merely serve to exert traction upon an already partly or fully profiled strip. Whenever it is desired to change from one strip profile to another, the traction and deformation rollers of all working stations must be replaced by others having the proper shape. This changeover from one roller configuration to another is relatively time-consuming and significantly reduces the output rate of an otherwise efficiently operating profiling machine.

OBJECT OF THE INVENTION

The object of my present invention, accordingly, is to provide an improved machine for the purpose described in which the changeover from one type of profile to another can be carried out in a rapid and convenient manner.

SUMMARY OF THE INVENTION

I realize this object, in accordance with the present invention, by providing at least some of the working stations (in a limiting case, a single working station) with a stationary support on which a carrier fitted with a plurality of roller mountings is adjustably disposed so that these mountings can be selectively placed in an operative position in line with the transport path followed by the workpieces, the mountings holding differently contoured roller pairs for potential engagement with a workpiece arriving over that path. In this way, a changeover from one profile to another merely requires a displacement of the carrier or carriers into a position of alignment of the corresponding roller pair or pairs with the transport path. Moreover, a roller pair previously used can be removed from an idle mounting and replaced by another pair, required for a subsequent changeover, even while a further roller pair is in operation. Thus, the shaping of workpieces need not be interrupted for more than the time necessary to change from one carrier position to another.

The displacement of a carrier during standstill of the machine can be performed by hand, yet I prefer to utilize powerdriven adjusting means for this purpose. In the case of an annular carrier, for example, the adjusting means may comprise a smooth-rimmed or toothed wheel coacting with a peripheral carrier surface in frictional or meshing engagement therewith. The adjusting wheel may be so oriented or shaped as to exert upon the carrier an axial force component holding it in position on its support, e.g. on a frame in the form of a ring or ring segment centered on the carrier axis. The carrier could also be star-shaped, in which case its support can include a shaft also serving as the adjusting means.

In principle, each roller mounting on a carrier may be provided with its own drive means for rotating the associated roller pair. A simpler and therefore preferred arrangement, however, utilizes coupling means for connecting the roller shafts of a mounting to an external driving unit only when that mounting is in its operating position. The driving unit may be a motor individual to the carrier of a working station or a branch of a transmission powered by a motor common to several or all stations.

BRIEF DESCRIPTION OF THE DRAWING

The above and other features of my invention will now be described in detail with reference to the accompanying drawing in which.

SPECIFIC DESCRIPTION

Figure 1:
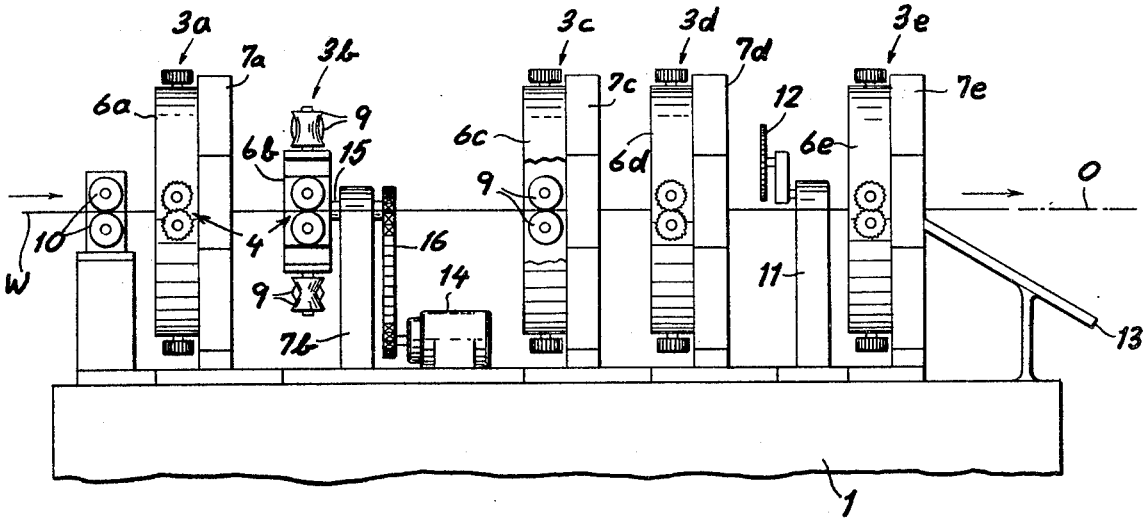
FIG. 1 is a somewhat diagrammatic side-elevational view of a profiling machine embodying my invention.

The machine shown in FIG. 1 comprises a base 1 supporting a multiplicity of cascaded working stations 3*a*, 3*b*, 3*c*, 3*d* and 3*e* of the interchangeable-roller type according to my invention. Stations 3*a*, 3*c*, 3*d* and 3*e* are substantially identical and will be described hereinafter in greater detail with reference to FIGS. 2 and 3. Station 3*b* has the structure shown in FIG. 6 and will also be more fully described hereinafter. Each of these stations includes a stationary support 7*a*, 7*b*, 7*c*, 7*d*, 7*e* for a rotatable carrier 6*a*, 6*b*, 6*c*, 6*d*, 6*e*, the carriers being all centered on a common horizontal axis. Each carrier is fitted with a plurality of peripherally separated mountings 4 adapted to hold respective roller pairs 9, some of which are visible at stations 3*b* and 3*c*. Two of the roller pairs of each carrier are horizontally positioned on the level of the carrier axis O and on diametrically opposite sides of that axis, the totality of the operatively positioned roller pairs defining a transport path for a pair of elongate workpieces W (only one shown) in the form of metal strips which, coming hot from a nonillustrated rolling mill, are to be profiled as they move through the machine. At the upstream end of the machine, the strips pass between respective pairs of cylindrical feed rollers 10 driven by a motor not shown. A cutting station 11 between working stations 3*d* and 3*e* comprises a pair of rotatable saw blades 12 (only one shown) that are lowerable upon the respective strips W to sever them into pieces of desired length which are then discharged from the machine via a chute 13 downstream of the last station 3*e*; the latter station, which is merely designed to stretch these workpieces during the cutting operation, has no shaping function yet its rollers obviously must conform to the profile imparted to the strips by the rollers of the preceding stations. The operatively positioned rollers of station 3*e*, and advantageously also of stations 3*a*, 3*c* and 3*d*, are positively driven by external means not shown in FIG. 1. It is assumed that the rollers of station 3*b* are not driven, even in their operating position, and merely idle on their shafts while deforming the cross-sections of strips W forced into their nips by the traction of the feed rollers 10 and, preferably, also by the positive rotation of the shaping rollers of station 3*a*. The rollers of station 3*d* may merely have a stress-relieving and thickness-equalizing function without imparting any significant further deformation to the workpiece.

In FIG. 1 each working station is equipped with four roller mountings 4 spaced 90° apart. Thus, their carriers need only to be swung through 90° in order to place one or the other pair of diametrically opposite roller mountings in the horizontal operating position. The means for angularly adjusting the carriers 6*a*, 6*c*, 6*d* and 6*e* have not been shown in FIG. 1; in the case of carrier 6*b*, however, I have illustrated a motor 14 driving the shaft 15 of that carrier via a chain 16. Cutter station 11 can be actuated manually, or automatically under the control of a timer.

Figure 2:
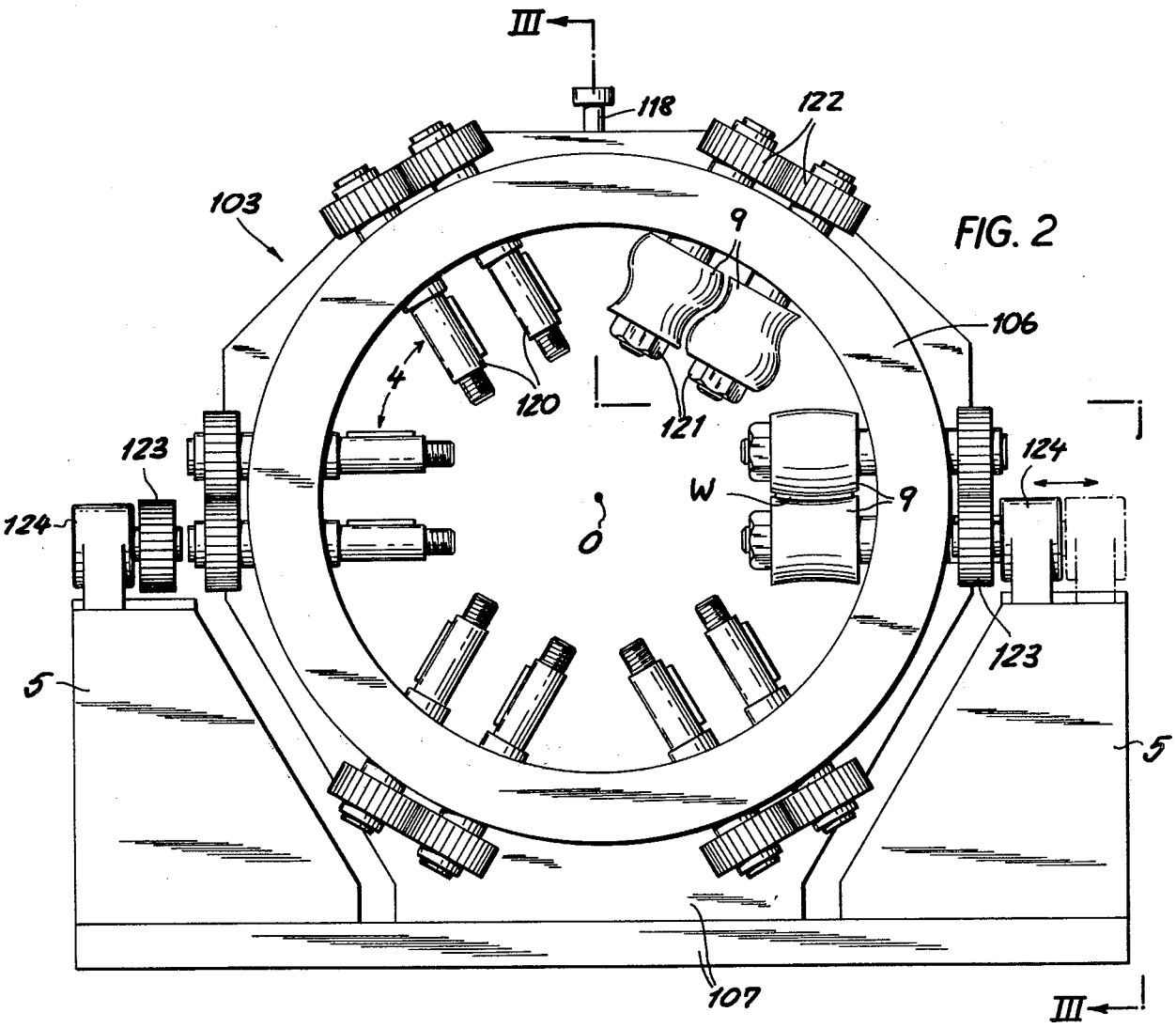
FIG. 2 is a face view, drawn to a larger scale, of a working station included in the machine of FIG. 1.
Figure 3:
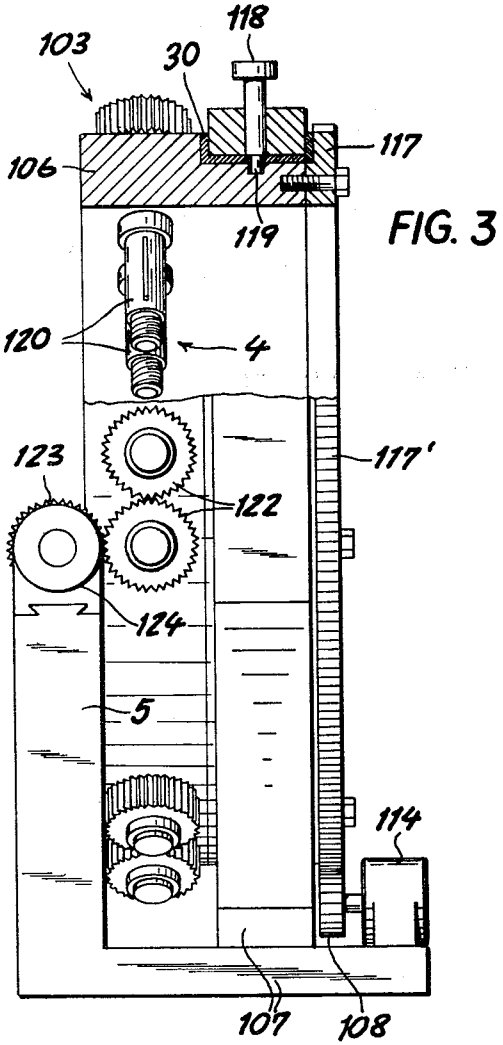
FIG. 3 is a side view of the station shown in FIG. 2, taken partly in section along the line III — III thereof.

In FIGS. 2 and 3 I have shown details of a station 103 which is representative of any of the stations 3*a*, 3*c*, 3*d* and 3*e* in FIG. 1, except for the presence of six angularly spaced roller mountings 4 instead of four such mountings as in FIG. 1. Station 103 comprises an annular supporting frame 107 in which a ring-shaped carrier 106 is concentrically journaled. A motor 114 drives a pinion 108 which meshes with a set of peripheral gear teeth 117' on an annular disk 117 which is fastened to the rear face of carrier ring 106 to hold it in position within frame 107. Motor 114 is energized only when it is desired to change the angular position of carrier 106 for the purpose of switching to a different strip profile as discussed above. A detent 118 on frame 107 is engageable with one of several radial bores 119 (only one shown) in ring 106 for the purpose of indexing same in at least three different positions spaced 60° apart. Detent 118 may be manually operable but could also be automatically actuated, e.g. by a solenoid.

Each roller mounting 4 comprises a pair of parallel, generally radially oriented shafts 120 to which profiled rollers 9 may be secured by nuts 121 in keyed relationship. The shafts 120 of each mounting carry respective pinions 122 in mesh with each other whereby the associated rollers 9 are counterrotated when one of these pinions is set in rotation by a driving pinion 123 of a motor 124 which is shiftably disposed on a stand 5; two such stands are shown provided at diametrically opposite locations in FIG. 2 for the simultaneous advance of a pair of workpieces W on opposite sides of carrier axis 0. Thus, withdrawal of the two motors 124 into a position of disengagement of their pinions 123 enables the carrier 126 to be angularly adjusted by motor 114 whereupon pinions 123 can be re-extended to mesh with pinions 122 of roller mountings 4 now occupying the operating position. As noted above, and as further described below with reference to FIG. 4, the individual motors 124 of station 103 may be replaced by a pair of drive units powered by two motors (or possibly a single motor) common to all the working stations 3*a*, 3*c*, 3*d*, 3*e* of FIG. 1.

Figure 4:
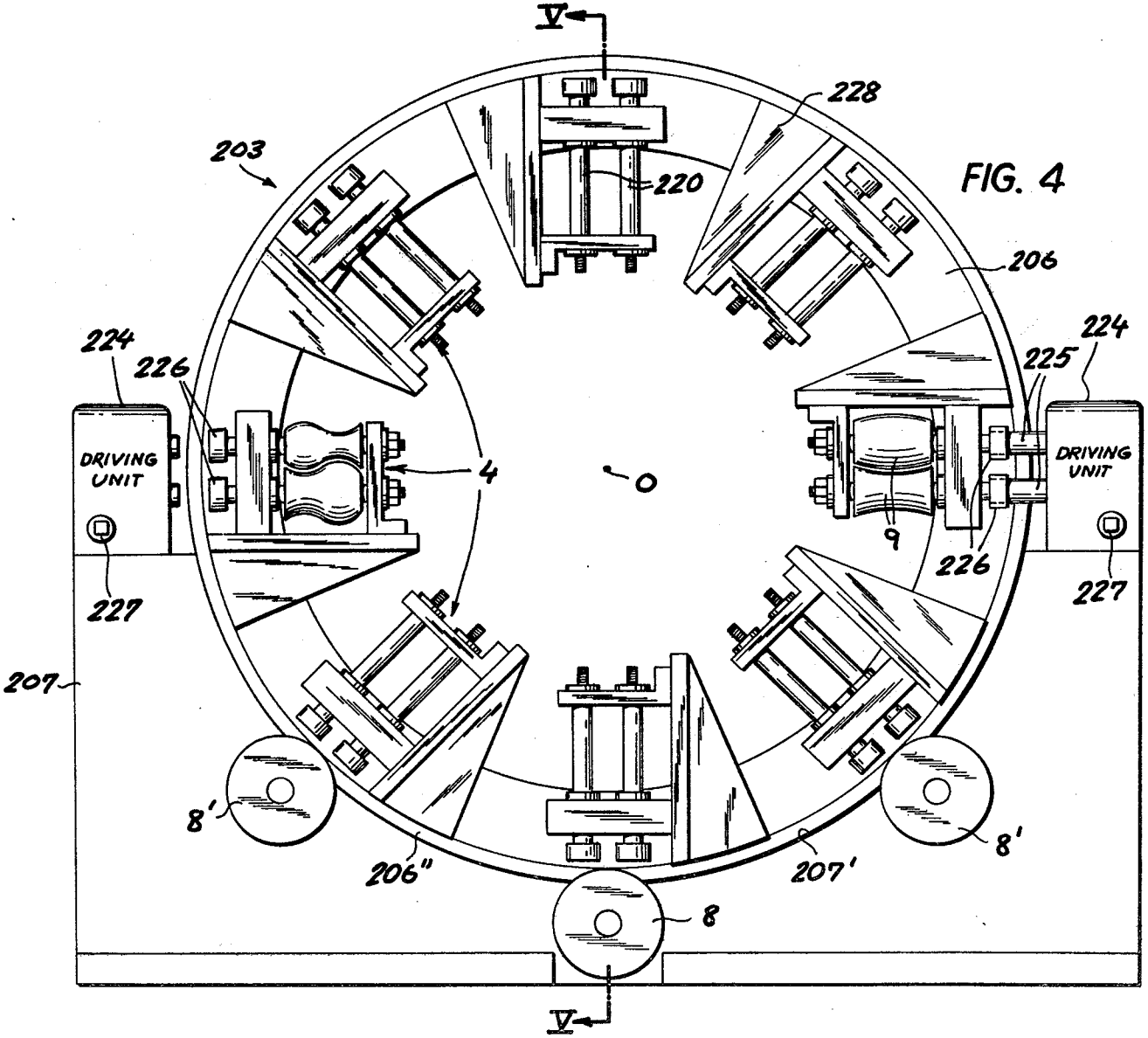
FIG. 4 is a view similar to FIG. 2, illustrating a modified working station.
Figure 5:
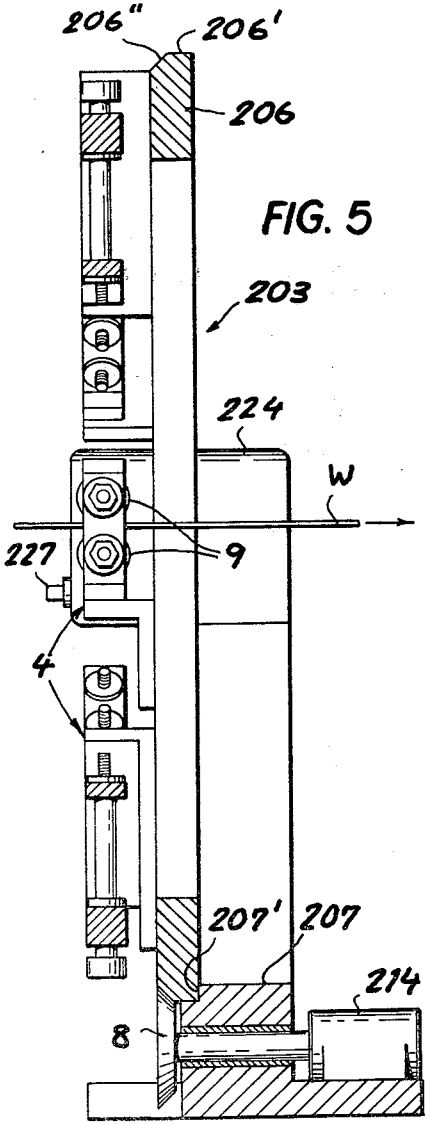
FIG. 5 is a cross-sectional view taken on the line V — V of FIG. 4.

In FIGS. 4 and 5 I have shown a modified working station 203 in which an annular carrier 206 is received in a nearly semicircular cutout of a supporting frame 207. A peripheral surface 206' of carrier 206 is cradled in a rabbet 207' of frame 207 while a beveled face 206'' of the carrier projects forwardly (i.e. in the direction of the oncoming workpieces W) beyond the frame and rests on a complementarily beveled friction wheel 8 driven by a motor 214. Rotation of wheel 8, therefore, angularly adjusts the carrier 206 to position two of its roller mountings 4 at the level of its axis 0 for engagement of their rollers 9 with respective workpieces W. The mountings 4 are secured to respective shelves 228 extending inwardly from the carrier periphery.

Rabbet 207' forms an axial backstop for carrier 206 against which that carrier is urged by the tension of strips W engaged by traction rollers of another station further downstream. Moreover, the beveling of wheel 8 retains the carrier in its illustrated axial position close to frame 207 and, together with similar wheels 8' which may or may not be drivingly coupled with wheel 8, prevents a forward tilting of the carrier. It will be understood that wheel 8 could also be toothed to mesh with coacting teeth on the beveled face 206' for a positive carrier adjustment similar to that obtainable with gear coupling 108, 117' in FIG. 3.

In the embodiments of FIGS. 2, 3 and 4, 5 the frame 107 or 207 is preferably provided with an antifriction layer 30 at its surfaces in contact with carrier 106 or 206; the antifriction layer could also be replaced by roller bearings or the like.

As further shown in FIGS. 4 and 5, carrier 206 is flanked by a pair of driving units 224 mounted on frame 207. Each of these units has a pair of output shafts 225 which can be axially extended for driving engagement with roller shafts 220 through the intermediary of coupling sleeves 226, the pinions 122 of the preceding embodiments being omitted in this instance. The several driving units 224 of successive stations may be interlinked by shafts 227 for joint operation by a common motor.

Figure 6:
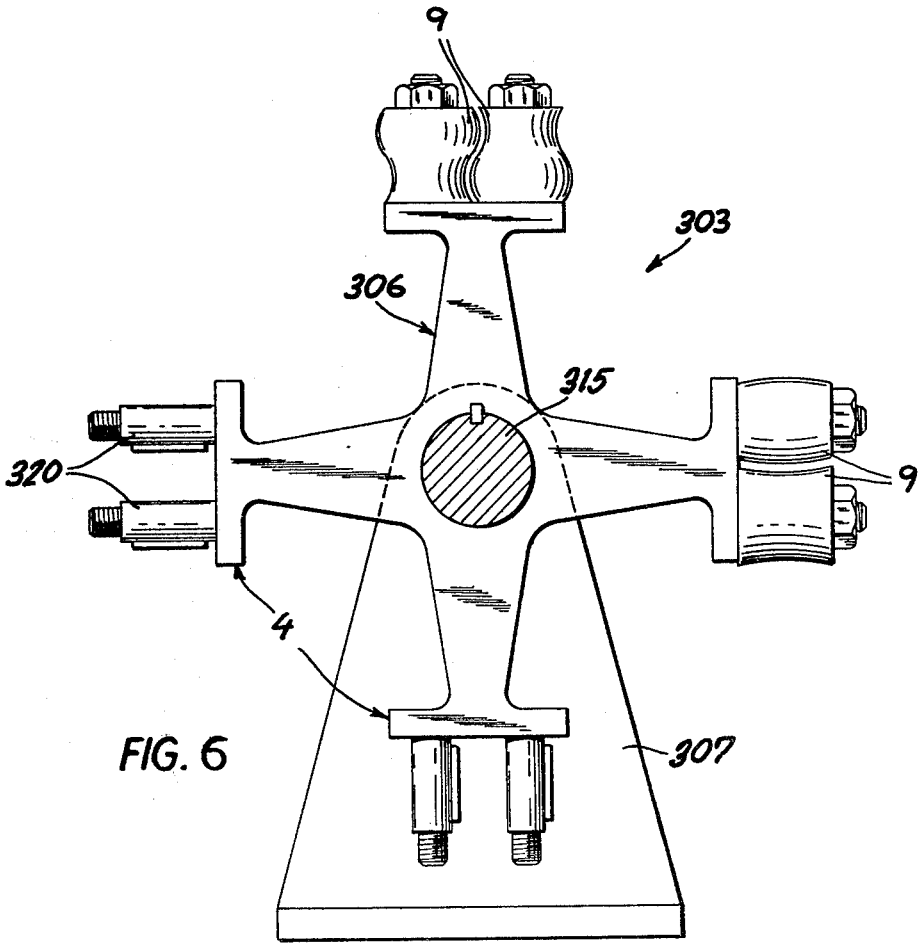
FIG. 6 is a view similar to FIGS. 2 and 4, illustrating a further type of working station.

In FIG. 6 I have shown a working station 303 of the type illustrated at 3*b* in FIG. 1. This station comprises a frame 307 traversed by a shaft 315 on which a star-shaped carrier 306 is mounted. Carrier 306 has several (here two) pairs of radial arms each terminating in a roller mounting 4 generally similar to the mountings of the preceding embodiments. Although not so illustrated, shafts 320 of these roller mountings could be provided at their free ends with meshing pinions, similar to those shown at 122 in FIGS. 2 and 3, engageable by a driven pinion 123 as also shown in these earlier Figures. Otherwise, rollers 9 may just idle on their shafts 320 for passive deformation of workpieces W as described with reference to station 3*b* of FIG. 1.

Naturally, the number of working stations in a machine as shown in FIG. 1 may vary widely and their functions (performing, final shaping, equalizing, tensioning) may differ. The workpieces may be subjected to forced cooling, as by a water spray, before reaching the equalizer station 3*d* or the cutting station 11. The latter station can be omitted if the workpieces delivered to feed rollers 10 are already of the requisite length.

I claim:

1. A machine for profiling flat elongate workpieces by progressive deformation of their cross-sections, comprising:

a plurality of cascaded working stations disposed along a transport path and provided with shaping means engageable with a workpiece to be profiled, at least one of said working stations comprising a stationary support having an at least partly ring-shaped body on an axis parallel to said transport path and an annular carrier coaxial with said support encompassing said transport path, said carrier being rotatably held on said support and being fitted with a plurality of peripherally spaced, inwardly extending roller mountings selectively placeable in an operating position in line with said transport path by rotation of said carrier, said shaping means including differently contoured roller pairs respectively held on said mountings for potential engagement with a workpiece arriving over said transport path; and drive means for advancing said workpieces along said transport path.

2. A machine as defined in claim 1 wherein each of said mountings comprises a pair of parallel, substantially radially oriented shafts.

3. A machine as defined in claim 2 wherein said shafts are provided with coupling means engageable with said drive means in said operating position for positive rotation of the rollers held thereon, said drive means being disposed adjacent the outer periphery of said carrier.

4. A machine as defined in claim 3 wherein said drive means is duplicated at diametrically opposite locations of said outer periphery for concurrently actuating two of said roller pairs to operate on respective workpieces.

5. A machine as defined in claim 1, further comprising indexing means for arresting said carrier in a selected angular position.

6. A machine as defined in claim 1, further comprising power-driven adjusting means actuatable to rotate said carrier about said axis to place a selected mounting thereof in said operating position.

7. A machine as defined in claim 6 wherein said carrier is partly received in a peripheral groove of said body, said ajusting means comprising a wheel with a beveled surface overlying said groove and coacting with a peripheral surface of said carrier, said beveled surface exerting upon said carrier an axial force component holding same in position in said groove.

* * * * *